US005253554A

United States Patent [19]

Riera et al.

[11] Patent Number: 5,253,554

[45] Date of Patent: Oct. 19, 1993

[54] POWER DRIVEN HOSE CLAMP TOOL

[76] Inventors: Salvatore J. Riera, 61801 Cetnor, Washington, Mich. 48094; Brent A. Thorn, 23090 Halsted, Apt. 208, Farmington Hills, Mich. 48035

[21] Appl. No.: 982,470

[22] Filed: Nov. 27, 1992

[51] Int. Cl.[5] ..... B25B 27/10

[52] U.S. Cl. ..... 81/9.3; 81/345; 81/423; 81/426; 29/252; 29/267; 30/228; 72/453.16

[58] Field of Search ..... 81/9.3, 345, 423, 426; 29/252, 267; 30/228, 210, 216; 72/450, 453.16

[56] References Cited

U.S. PATENT DOCUMENTS

| | | | |
|---|---|---|---|
| 3,111,870 | 11/1963 | Anderson | 81/9.3 |
| 3,893,237 | 7/1975 | Jahnke | 30/228 |
| 4,283,851 | 8/1981 | Wolter | 30/228 X |
| 4,558,584 | 12/1985 | Myers | 72/453.16 X |
| 4,587,732 | 5/1986 | Lind et al. | 30/228 X |
| 5,125,296 | 6/1992 | Nelson et al. | 81/9.3 |
| 5,152,713 | 10/1992 | Baertlein | 30/228 X |

FOREIGN PATENT DOCUMENTS

| | | | |
|---|---|---|---|
| 2459707 | 2/1981 | France | 81/345 |

OTHER PUBLICATIONS

Power Driven Hose Clamp Depiction of Device Manufactured by Dresser Ind., Wixom, Mich. for Mubea, Inc. of Florence, Ky. dated on or before Feb. 1992.

Fact Sheet on Spring Tension Clamps Manufactured by Mubea, Inc. dated around Apr. 1991.

*Primary Examiner*—James G. Smith

*Attorney, Agent, or Firm*—Peter D. Keefe

[57] ABSTRACT

A power driven hose clamp tool composed generally of a handle component and an actuator component. The handle component includes an operator handle and a head connected with one end of the handle. The actuator component includes a main body which removably connects with the head and contains a power drive unit which reciprocably moves a T-bar in response to selective pressing of push button controls. Pivotally connected with the T-bar are a pair links which are in turn pivotally connected, respectively, with the near end of a pair of arms. The pair of arms are connected pivotally to the main body. The distal end of the pair of arms is provided with claws for gripping the wings of a spring tension clamp. The pair of links operate in combination with the pair of arms so as to provide a high mechanical advantage due to the scissor-like operation thereof. The preferred power drive unit is a pneumatically operated spring biased piston-cylinder unit contained in the main body and fluidically connected to an external pneumatic system at the handle. A push button operated inlet valve actuates closure of the claws only when depressed, and a push button operated outlet valve vents air pressure only when depressed, thereby resulting in the spring causing the piston to move so as to open the claws. An adjustment screw permits selective adjustment of the distance between claws when fully open and a needle valve permits adjustment of the rate of closing of the claws when the inlet valve is depressed.

18 Claims, 3 Drawing Sheets

POWER DRIVEN HOSE CLAMP TOOL

BACKGROUND OF THE INVENTION

1. Field of the Invention:

The present invention relates to pneumatic tools used for removing and installing tension spring hose clamps used for resiliently clamping an end of a hose over a terminal portion of a tube. Still more particularly, the present invention relates to a power driven tool of the aforesaid class having the advantages of separate controls for actuation and release and high mechanical advantage via a scissor-like linkage.

2. Description of the Prior Art:

It is well known in the art to utilize resilient hose to conduct fluids. The hose is usually connected at either end to various components of a system, the connection being accomplished by slipping an end portion of the hose resiliently over a terminal portion of the tube. Ordinarily, such a press fit between the hose and the tube is not tight against leakage, especially in the event that the fluid conducted through the hose is under pressure. Accordingly, it is common practice to place an annular clamp over the hose in coaxial alignment with the tube so as to clamp the hose tightly against the tube and thereby prevent fluid leakage.

While a number of different clamps are well known, such as those which are clamped by being tightening a threaded fastener connected therewith, a very successful, simply and effective clamp is a spring tension clamp. A spring tension clamp is constructed of a resilient material and is shaped in the form of a circular loop having at either end of the loop wings which overlap each other and which are oriented more or less perpendicular to the loop. The concept of operation of spring tension clamps is that in the relaxed state the diameter of the loop in relation to that of the hose is such that the loop resiliently pinches the hose against the tube, and that by mutually squeezing together the wings, the loop diameter is caused to expand so as to permit installation or removal of the spring tension clamp with respect to the hose. To accomplish installation, the user positions of the spring tension clamp and then releases the wings, thereby resulting in the loop resiliently pinching the hose against the tube. To accomplish removal, the user mutually squeezes the wings so as to relieve clamping pressure on then hose, removes the hose from the tube, slides the spring tension clamp off the hose and then releases the wings.

A substantial amount of force is needed to mutually squeeze the wings, consequently tools are used for this purpose. It is known to use a hose clamp tool structured similarly to a pair of pliers for manually accomplishing this result. In this regard, the operator must manually apply the necessary squeezing force for the duration of time needed to squeeze the wings, a feat of hand strength that rapidly becomes tiring with each repetition. Accordingly, a power driven tool is preferred for performing repetitive clamp installation/removal tasks.

One power driven hose clamp tool is manufactured Dresser Industries of Wixom, Mich. for by Mubea Corporation of Germany, having a plant in Florence, Ky.; Mubea is, a company that is also a major supplier of spring tension clamps. This hose clamp tool is pneumatically powered and consists of a dual piston-cylinder unit which pushes a triangle shaped wedge having slots; rollers on the jaws (or ears) reside in the slots and are thereby forced open through what amounts to an incline plane mechanical linkage means.

This type of linkage has a considerable number of wearable parts, in particular there is abrasive rubbing of the wedge and the contacting jaw portion. This type of linkage has a relatively low mechanical advantage which necessitates use of a double piston system to intensify the force at the wedge from a predetermined reasonable amount of pneumatic pressure. Consequently, the German hose clamp tool is heavy, bulky, expensive to maintain, and where lighter parts such as nylon are substituted for heavier metallic parts, subject to even higher levels of parts repair and replacement.

Another disadvantage of the German tool is that the single valve control is structured so that when pneumatic pressure is established at the coupling, the jaws automatically close. Thus, the German tool tends to be dangerous for less than perfectly careful users.

Accordingly, what is needed in the art is a hose clamp tool which is safe, efficient, durable and easy to use and control.

SUMMARY OF THE INVENTION

The present invention is a hose clamp tool which is power driven, is easy to control and use and is durable, efficient and cost effective.

The hose clamp tool according to the present invention is composed generally of a handle component and an actuator component. The handle component includes an operator handle and a head connected with one end of the handle. The actuator component includes a main body which removably connects with the head and contains a power drive unit which reciprocably moves a T-bar in response to selective pressing of push button controls. Pivotally connected with the T-bar are a pair links which are in turn pivotally connected, respectively, with the near end of a pair of arms. The pair of arms are connected pivotally to the main body. The distal end of the pair of arms is provided with claws for gripping the wings of a spring tension clamp. The pair of links operate in combination with the pair of arms so as to provide a high mechanical advantage due to the scissor-like operation thereof.

The preferred power drive unit is a pneumatically operated spring biased piston-cylinder unit contained in the main body and fluidically connected to an external pneumatic system at the handle. A push button operated inlet valve actuates closure of the claws only when depressed, and a push button operated outlet valve vents air pressure only when depressed, thereby resulting in the spring causing the piston to move so as to open the claws. An adjustment screw permits selective adjustment of the distance between claws when fully open and a needle valve permits adjustment of the rate of closing of the claws when the inlet valve is depressed.

Accordingly, it is an object of the present invention to provide a spring tension hose clamp power driven tool which has a high mechanical advantage, and is light weight and durable.

It is an additional object of the present invention to provide a spring tension hose clamp power driven tool which has a high mechanical advantage due to a mechanical linkage which operates on a scissors principle.

It is another object of the present invention to provide a spring tension hose clamp power driven tool which has a high mechanical advantage due to a mechanical linkage which operates on a scissors principle, and further has selective control over actuation so as to permit a user to define the degree of closure of the claws thereof.

It is an additional object of the present invention to provide a spring tension hose clamp power driven tool which has a high mechanical advantage due to a mechanical linkage which operates on a scissors principle, having an adjustment feature which allows for user selected control over the rate of closure of the claws thereof.

It is an additional object of the present invention to provide a spring tension hose clamp power driven tool which has a high mechanical advantage due to a mechanical linkage which operates on a scissors principle, having an adjustment feature which allows for user selected control over the degree of separation of the claws thereof.

These, and additional objects, advantages, features and benefits of the present invention will become apparent from the following specification.

DETAILED DESCRIPTION OF THE PREFERRED EMBODIMENT

Figure 1:
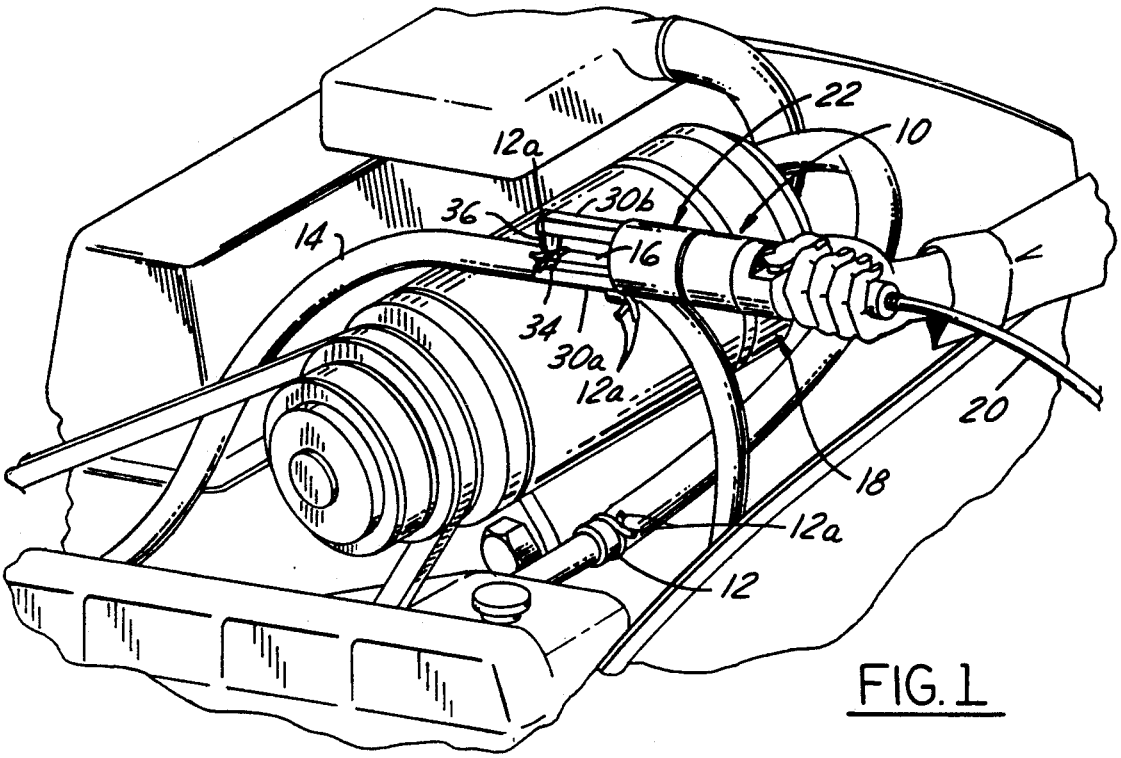
FIG. 1 is a perspective view of the hose clamp tool according to the present invention, shown being used by an operator to manipulate a hose clamp for a hose in an automotive environment.

Referring now to the Drawing, FIG. 1 shows the hose clamp tool 10 according to the present invention in operation with regard to installing a spring tension hose clamp 12 near the end of a hose 14 which has been placed coaxially over the end portion of a tube 16. The hose 14 may have a resilient press fit over the tube 16, yet this will usually not provide a sufficiently tight fit to prevent pressurized fluid from leaking between the hose and the tube. Accordingly, the spring tension hose clamp 12 has a circular cross-section preselected relative to that of the outer diameter of the hose 14 so that it tightly clamps about the hose by tensionably pinching the hose against the tube 16 when the spring tension hose clamp is in its relaxed state, thereby sealing the hose with respect to the tube against leakage. In order for the spring tension hose clamp 12 to be selectively pinchable with respect to the hose 14, it is provided with a pair of opposing wings 12*a* which when mutually squeezed together, cause the spring tension hose clamp to expand and thereby be selectively removable or installable with respect to the hose 14. A typical environment of operation of a spring tension hose clamp 14 is the automotive engine compartment area shown in FIG. 1.

While a hose clamp tool 10 having a drive system featuring a pneumatic drive is disclosed herein by way of preferred example, it will be clear to those of ordinary skill in the relevant art from the disclosure herein that other drive systems can be substituted for the described pneumatic drive system, as for instance an analogously operating and structured hydraulic drive system. Other drive systems are possible, too, such as a pneumatic or hydraulic motor drive system or an electric motor drive system (with or without an internal battery). An example of a structure for implementing a motor driven drive is for a drive screw connected with the motor to thread with respect to an axial threaded bore in the piston to thereby cause reciprocation of the T-bar. Whatever type drive unit selected to cause reciprocation of the T-bar, the scissor-like linkage 32 remains structurally the same.

Figure 6:
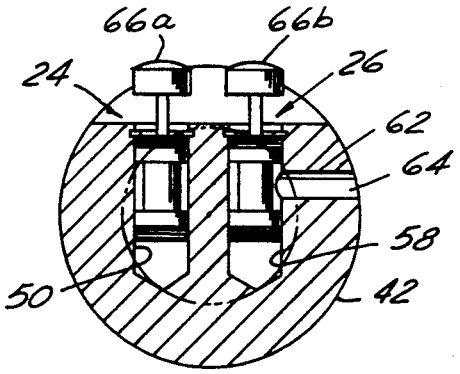
FIG. 6 is a partly sectional detail view of the inlet and outlet valves for controlling the hose clamp tool according to the present invention, seen along lines 6—6 in FIG. 5.
Figure 5:
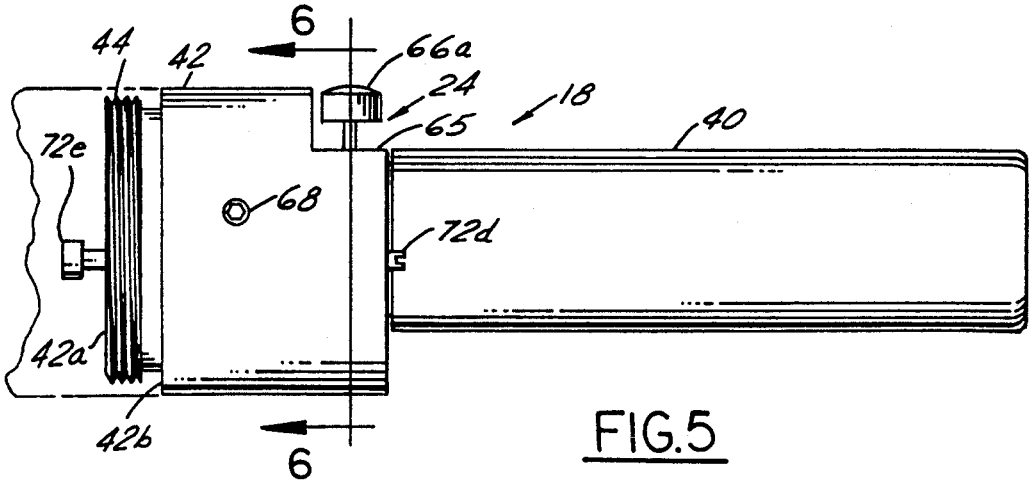
FIG. 5 is a side view of the handle component of the hose clamp tool according to the present invention.

The hose clamp tool 10 includes, generally, a handle component 18 to which is connected to a pneumatic line 20, and in actuator component 22. The handle component 18 includes an inlet valve 24 and an outlet valve 26 (see FIG. 6). The actuator component 22 includes an internal piston-cylinder unit 28 (see FIG. 4) which actuates a pair of first and second arms 30*a*, 30*b* via a scissor-like mechanical linkage 32 (see FIG. 4). The distal end of the first arm 30*a* has a male claw 34, while the distal end of the second arm 30*b* has a female claw 36. The claws 34, 36 are shaped to grippably receive the wings 12*a* of the spring tension hose clamp 12 so as to mutually squeeze them as shown in FIG. 1 when the piston-cylinder unit 28 is selectively actuated.

Figure 2:
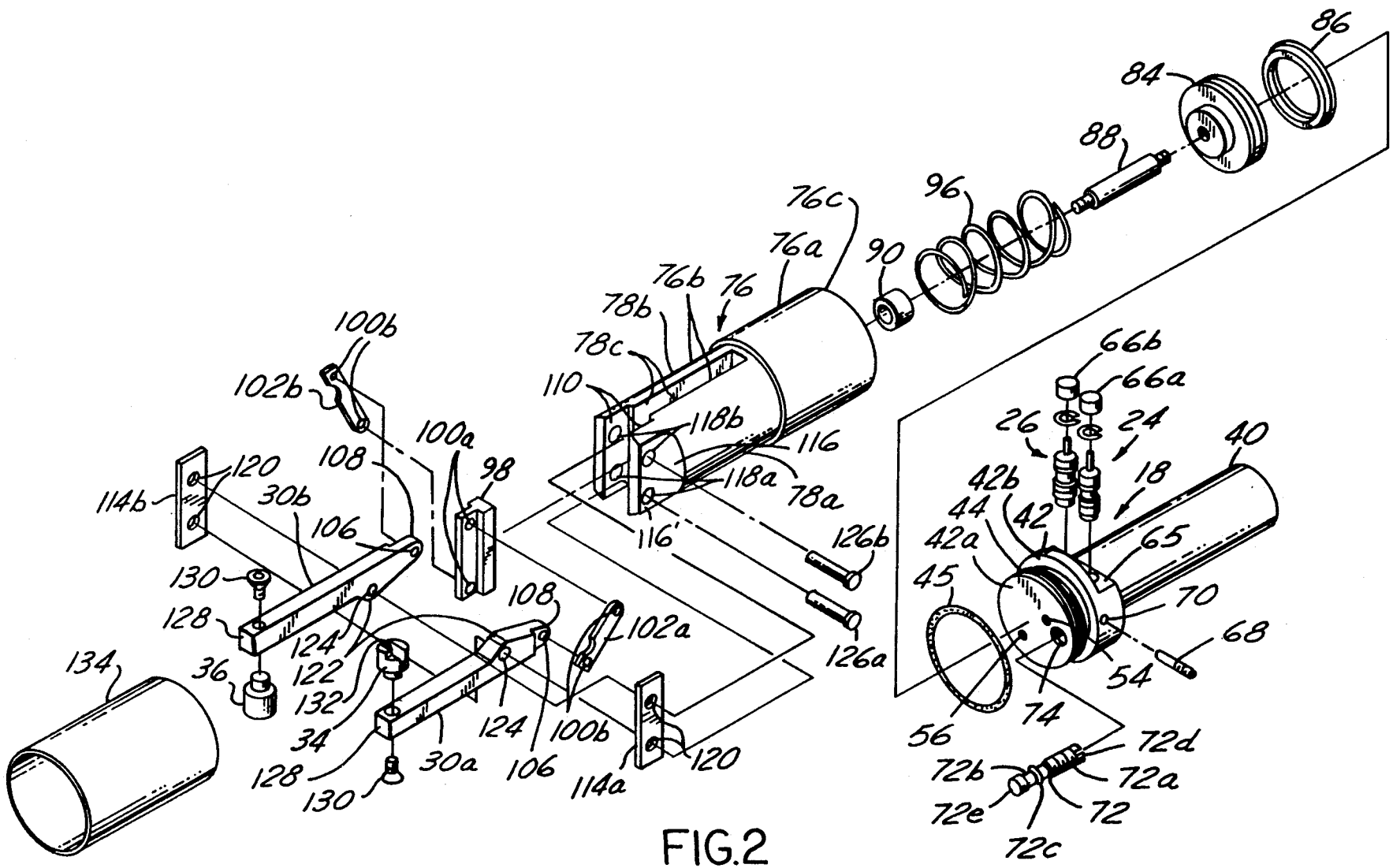
FIG. 2 is an exploded perspective view of the hose clamp tool according to the present invention.
Figure 3:
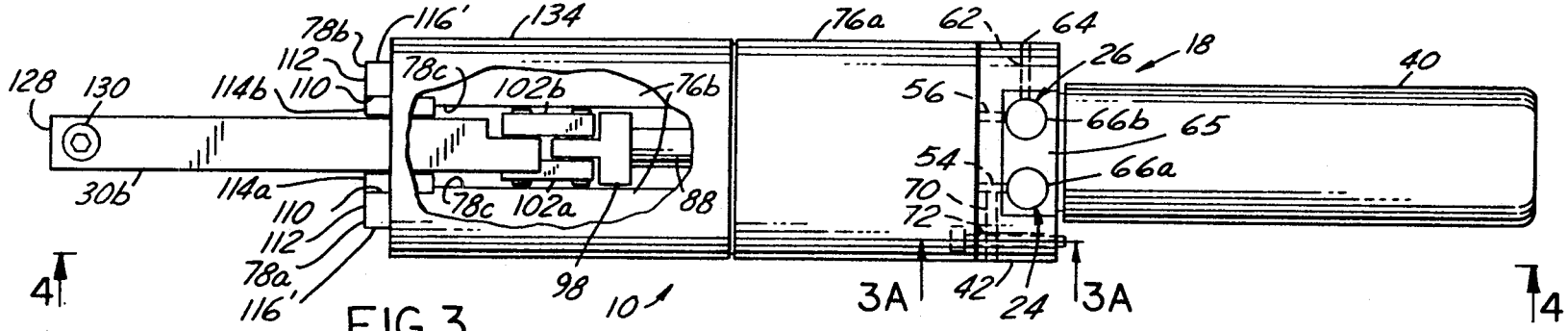
FIG. 3 is a partly cut-away plan view of the hose clamp tool according to the present invention.
Figure 3A:
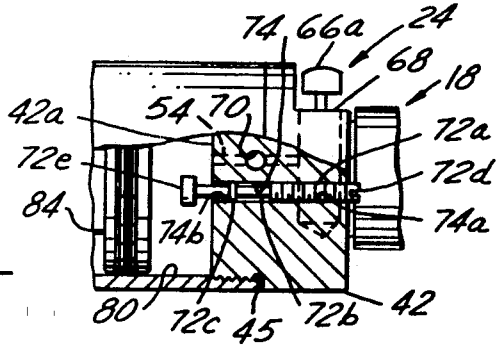
FIG. 3A is a partly sectional detail view of the hose clamp tool according to the present invention, seen along lines 3A—3A in FIG. 3.
Figure 4:
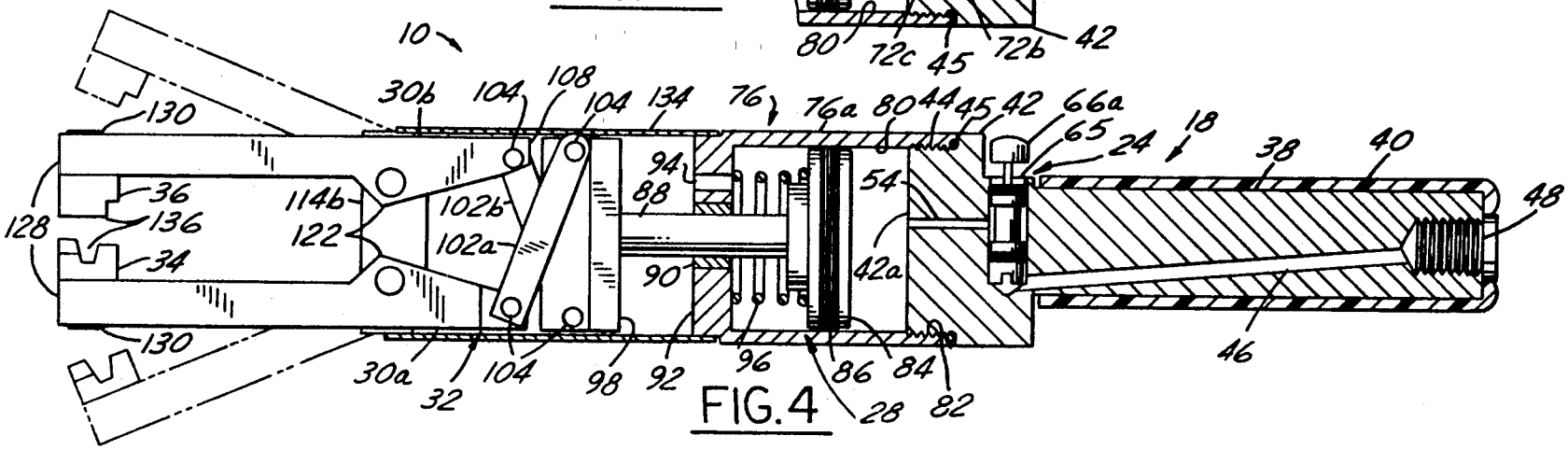
FIG. 4 is a partly sectional side view of the hose clamp tool according to the present invention, seen along lines 4—4 in FIG. 3.

The structure and function of the hose clamp tool 10 will now be detailed with reference being directed in particular to FIGS. 2 through 4.

The handle component 18 is composed of a handle 38 having preferably a cylindrical shape and an integrally connected cylindrically shaped head 42. The handle component 18 is preferably constructed of aluminum, and the handle 38, which is dimensioned for being held in the hand of an operator, is preferably covered with a plastic sheath 40 for providing a grippable surface thereon. The head 42 is provided with exterior threads 44.

A primary inlet passage 46 is provided through the handle 38, commencing at a pneumatic line adapter 48 for connecting the pneumatic line 20 thereto and terminating at an inlet valve seat 50. The aforementioned inlet valve 24 is located within the inlet valve seat 50. The inlet valve 24 is a spring biased, push button type for control of pneumatic lines, such as that manufactured by Clippard Company, part number MAV-2C. A secondary inlet passage 54 is provided in the head 42, extending between the inlet valve seat 50 and the forward facing end 42*a* of the head 42. The inlet valve 24 is spring biased so as to normally close off the secondary inlet passage 54 from the primary inlet passage 46; the passages 54, 46 being fluidically communicating when the push button 66*a* of the inlet valve 24 is pressed.

A primary outlet passage 56 is provided in the head 42 between the forward facing end 42*a* thereof and an outlet valve seat 58. The aforesaid outlet valve 26 is located within the outlet valve seat 58 having the same construction as that of the inlet valve 24. A secondary outlet passage 62 is provided in the handle 38, extending from the outlet valve seat 58 to an exterior outlet aperture 64. The outlet valve 26 is spring biased so as to normally close off the primary outlet passage 56 from the secondary outlet passage 62; the passages 56, 62 being fluidically communicating when the push button 66b of the outlet valve 26 is pressed.

Rate of flow of air from the connector adapter 48 to the forward face 42a is regulated by a needle valve 68 which is located in a needle valve seat 70 that communicates with the secondary inlet passage 54. Threadable adjustment of the needle valve 68 within the needle valve seat 70 results in selective restriction of the secondary inlet passage 54 between the forward facing end 42a and the inlet valve seat 50.

Preferably a shoulder 65 is provided on the head 40 for providing a convenient placement of the push buttons 66a, 66b of the inlet and outlet valves 24, 26, respectively.

An adjustment screw 72 is threadably connected with the head 42 for providing selective adjustment of the maximum open orientation of the arms 30a, 30b, as will be made clear hereinbelow. A bore 74 is provided in the head 42 having a threaded portion 74a and a smooth portion 74b. The adjustment screw 72 includes a threaded portion 72a and a smooth portion 72b which carries an "O" ring 72c. The threaded portion 72a of the adjustment screw 72 threadably engages with the threaded portion 74a of the bore 74, while the "O" ring 72c smoothly and sealably slides along the smooth portion 74b of the bore. A driving end 72d is located at the exterior facing end of the adjustment screw, while the opposite end adjacent the facing end 42a of the head 42 is provided with a foot 72e.

The actuator component 22 is composed of a main body 76 having a cylinder portion 76a and a clevis portion 76b formed by two parallel legs 78a, 78b, and is further composed of the aforementioned arms 30a, 30b and the associated scissor-like linkage 32.

The interior of the cylinder portion 76a carries a bore which provides a smooth-walled cylinder 80. The cylinder 80 is provided with threads 82 which are structured to threadably engage with the threads 44 on the head 42. In this regard, a gasket 45 provides a leak tight seal between the end 76c of the cylinder portion 76a and an annular shoulder 42b on the head 42. A piston 84 carrying a U-cup piston ring 86 is dimensioned to slidably reciprocate sealably within the cylinder 80. The piston 84 has a piston rod 88 threadably connected thereto which extends through an axially aligned bushing 90 in a head wall 92 of the cylinder 80. An air relief hole 94 is provided in the head wall 92 offset from the bushing 90. A coil spring 96 is situated between the head wall 92 and the piston 84 and biases the piston toward the facing end 42a of the head 42.

The end of the piston rod 88 threadably connects with a T-bar 98 which is dimensioned to fit between the legs 78a, 78b without contact therewith, while having a length approximately on the order of that of the cylinder 80. A hole 100a is provided at each end of the T-bar, and a first link 102a having a pair of holes 100b is connected at one end thereof pivotably via a rivet or the like 104 to one hole 100a in the T-bar, while one end of a second link 102b, also having a pair of holes 100b, is connected similarly to the other hole 100a in the T-bar. The other end of the first link 102a is pivotably connected by a rivet or the like 104 to a hole 106 at the near end 108 of the first arm 30a, whereat a recess is provided in order to accommodate the thickness of the first link. The other end of the second link 102a is pivotably connected by a rivet or the like 104 to a hole 106 at the near end 108 of the second arm 30a, whereat a recess is provided in order to accommodate the thickness of the second link. As can be discerned from FIG. 4, the first and second links 102a, 102b mutually form a cross-X pattern, which is the basis of the scissor-like linkage 32.

The legs 78a, 78b are substantially of semi-circular cross-section, having flat facing surfaces 78c mutually separated by a predetermined distance just wider than the width of the T-bar 98. The flat facing surfaces 78c at the ends 112 of the legs 78a, 78b remote from the cylinder 80 are provided, respectively, with a recess 110 for seating a wear plate 114a, 114b. Opposite the recess 110 of the legs 78a, 78b is a taper 116 resulting in a substantially flat section 116' at the ends 112 thereof. A pair of mutually spaced apart holes 118a, 118b are provided at the substantially flat section 116', the holes 118a, 118b aligning with holes 120 in the wear plates 114a, 114b. The first and second arms 30a, 30b have a maximum thickness at an apex 122 located preferably about one third the total length thereof from the near end 108. The arms taper gently from the apex 122 toward the near end 108 and taper rapidly on the other side of the apex. A mounting hole 124 is provided adjacent the apex 122 in each of the arms 30a, 30b. A first mounting pin 126a passes through aligned holes 118a in the legs 78a, 78b, through an aligned hole 120 in each of the wear plates 114a, 114b, and through the mounting hole 124 in the first arm 30a. Similarly, a second mounting pin 126b passes through aligned holes 118b in the legs 78a, 78b, through the other hole 120 in each of the wear plates 114a, 114b, and through the mounting hole 124 in the second arm 30b.

Preferably, the first and second links 102a, 102b each have an equal predetermined length, wherein the pivotal connection of said first arm 30a to the main body 76 is separated from the pivotal connection of the first link at said near end 108 thereof a distance substantially on the order of that of the aforesaid predetermined length of the first and second links, and wherein the pivotal connection of the second arm 30b to the main body is separated from the pivotal connection of the second link at the near end 108 thereof also a distance substantially on the order of that of the predetermined length of the first and second links.

Each of the arms 30a, 30b project a predetermined length from the respective first and second mounting pins 126a, 126b and terminate at a distal end 128. At the distal ends 128, are removably attached claws facing each other: the aforementioned male claw 34 connected by a screw 130 to the first arm 30a, and the aforementioned female claw 36 connected by a screw 130 to the second arm 30b. The male and female claws 34, 36 are provided with contours 132 for gripping the wings 12a of the spring tension hose clamps 12.

A sleeve 134 is provided to cover the clevis portion 76b of the main body 76.

In operation, the pneumatic line is connected to the adapter in the handle. The claws remain motionless, as the inlet valve is closed. The user then grabs the handle and brings the claws into the vicinity of the wings of a subject spring tension clamp. The user then depresses the push button of the inlet valve, thereby introducing compressed air into the cylinder and causing the piston to move toward the cylinder head wall. Piston movement causes the scissor-like linkage to pivot the arms on the mounting pins so that the claws move toward each other until the claws touch and then mutually squeeze the wings. The user may then release the push button of the inlet valve and the claws will continue to squeeze the wings. Accordingly, the user may manipulate the spring tension clamp with only one hand holding the handle, thereby freeing the other hand for manipulation of the hose or something else. Upon satisfactory installation placement or removal of the spring tension hose clamp, the user presses the push button of the outlet valve which thereupon vents the compressed air to the atmosphere. As the compressed air pressure is released, the bias of the spring on the piston toward the facing surface of the head causes the piston to travel toward the handle. The movement of the piston results in the claws separating from each other.

The user can control how much movement of the arms occurs by simply pressing or releasing the push buttons as desired to achieve a selected amount of movement. By adjustment of the adjusting screw the maximum extent of separation of the claws can be preselected. By adjustment of the needle valve so as to provide a predetermined throttling at the secondary inlet passage, the rate of movement of the claws toward each other can be preselected.

To those skilled in the art to which this invention appertains, the above described preferred embodiment may be subject to change or modification. Such change or modification can be carried out without departing from the scope of the invention, which is intended to be limited only by the scope of the appended claims.

What is claimed is:

1. A power driven hose clamp tool for gripping wings of a spring tension hose clamp of a predetermined diameter when in a relaxed state so as to selectively increase the diameter thereof by mutually squeezing the wings toward each other, said power driven hose clamp tool comprising:

handle means for providing a hand grip;

a main body connected with said handle means;

a first arm having a near end and an opposite distal end, said first arm being pivotally connected with said main body at a predetermined location between said near and distal ends thereof;

first claw means connected with said first arm at said distal end thereof;

a second arm having a near end and an opposite distal end, said second arm being pivotally connected with said main body at a predetermined location between said near and distal ends thereof;

second claw means connected with said second arm at said distal end thereof;

a T-bar having a first end and a second end;

scissor-like linkage means pivotally connected with said first and second ends of said T-bar and connected with said near end of each of said first and second arms for providing pivotal movement of said first and second arms in response to reciprocal movement of said T-bar;

drive means connected with said main body and connected to said T-bar at a location medially with respect to said first and second ends thereof for causing reciprocal movement of said T-bar with respect to said main body; and control means connected with at least one of said main body and said handle means for providing selective actuation of said drive means.

2. The power driven spring tension hose clamp tool of claim 1, wherein said scissor-like linkage means comprises:

a first link having a first end and a second end, said first end of said first link being pivotally connected with said first end of said T-bar, said second end of said first link being pivotally connected with said near end of said first arm; and a second link having a first end and a second end, said first end of said second link being pivotally connected with said second end of said T-bar, said second end of said second link being pivotally connected with said near end of said second arm;

wherein said first link is oriented with respect to said second link such that said first and second links mutually form a cross-X pattern.

3. The power driven spring tension hose clamp tool of claim 2, wherein said first and second links each have an equal predetermined length, said pivotal connection of said first arm to said main body being separated from said pivotal connection of said first link to said first arm a distance substantially equal to said predetermined length, said pivotal connection of said second arm to said main body being separated from said pivotal connection of said second link to said second arm a distance substantially equal to said predetermined length.

4. The power driven spring tension hose clamp tool of claim 3, wherein said drive means is a pneumatic drive means.

5. The power driven spring tension hose clamp tool of claim 4, wherein said control means comprises:

first control means connected with said drive means for selectively controlling reciprocable movement of said T-bar in a direction away from said handle means; and second control means connected with said drive means for selectively controlling reciprocable movement of said T-bar in a direction toward said handle means.

6. The power driven spring tension hose clamp tool of claim 5, wherein said pneumatic drive means and said control means comprise:

primary inlet passage means in said handle means for providing connection with an external supply of compressed gas and for providing a first passageway for said compressed gas through said handle means;

secondary inlet passage means for providing a second passageway of said compressed gas through said handle means;

inlet valve means fluidically connected with said primary inlet passage means and with said secondary inlet passage means for providing selective fluidic communication of said compressed gas between said primary inlet passage means and said secondary inlet passage means;

primary outlet passage means in said handle means for providing a third passageway for said compressed gas through said handle means;

secondary outlet passage means for providing a fourth passageway of said compressed gas through said handle means to an exterior outlet aperture therein;

outlet valve means fluidically connected with said primary outlet passage means and with said secondary outlet passage means for providing selective fluidic communication of said compressed gas between said primary outlet passage means and said secondary outlet passage means;

a cylinder located in said main body, said cylinder having a head wall at one end thereof remote from said handle means, said cylinder being sealably connected with said handle means so as to be in fluidic communication with said secondary inlet passage and said primary outlet passage;

a piston reciprocably mounted in said cylinder;

a piston rod having a first end and a second end, said first end of said piston rod being connected with said piston, said piston rod passing through said head wall of said cylinder, said second end of said piston rod being connected with said T-bar at said medial location thereof; and spring means situated between said head wall of said cylinder and said piston for providing a biasing force on said piston toward said handle means.

7. The power driven spring tension hose clamp tool of claim 6, wherein said first valve means comprises a push button actuated pneumatic valve that is normally closed, said first valve means being opened by a user depressing the push button thereof; and wherein said second valve means comprises a push button actuated pneumatic valve that is normally closed, said second valve means being opened by a user depressing the push button thereof.

8. The power driven spring tension hose clamp tool of claim 7, further comprising adjustment screw means connected with at least one of said handle means and said main body for providing an abutment for said piston so as to selectively provide a maximum distance of separation of said first and second claw means.

9. The power driven spring tension hose clamp tool of claim 8, further comprising needle valve means in said handle means and fluidically communicating with at least one of said secondary inlet passage means and said primary inlet passage means for providing selective throttling of said compressed gas into said cylinder in response to said push button of said inlet valve being depressed.

10. The power driven spring tension hose clamp tool of claim 9, wherein said main body comprises a clevis portion connected with said head wall of said cylinder, said clevis portion comprising a first leg terminating in an end and a second leg terminating in an end, said T-bar being reciprocable between said first and second legs, said pivotal connection of said first arm being located at said end of said first leg, said pivotal connection of said second arm being located at said end of said second leg.

11. A power driven hose clamp tool for gripping wings of a spring tension hose clamp of a predetermined diameter when in a relaxed state so as to selectively increase the diameter thereof by mutually squeezing the wings toward each other, said power driven hose clamp tool comprising:

handle means for providing a hand grip;

a main body connected with said handle means;

a first arm having a near end and an opposite distal end, said first arm being pivotally connected with said main body at a predetermined location between said near and distal ends thereof;

first claw means connected with said first arm at said distal end thereof;

a second arm having a near end and an opposite distal end, said second arm being pivotally connected with said main body at a predetermined location between said near and distal ends thereof;

second claw means connected with said second arm at said distal end thereof;

a T-bar having a first end and a second end;

scissor-like linkage means pivotally connected with said first and second ends of said T-bar and connected with said near end of each of said first and second arms for providing pivotal movement of said first and second arms in response to reciprocal movement of said T-bar, said scissor-like linkage means comprising:

a first link having a first end and a second end, said first end of said first link being pivotally connected with said first end of said T-bar, said second end of said first link being pivotally connected with said near end of said first arm; and a second link having a first end and a second end, said first end of said second link being pivotally connected with said second end of said T-bar, said second end of said second link being pivotally connected with said near end of said second arm;

wherein said first link is oriented with respect to said second link such that said first and second links mutually form a cross-X pattern;

drive means connected with said main body and connected to said T-bar medially between said first and second ends thereof for causing reciprocal movement of said T-bar with respect to said main body; and control means connected with at least one of said main body and said handle means for providing selective actuation of said drive means, wherein said control means comprises:

first control means connected with said drive means for selectively controlling reciprocable movement of said T-bar in a direction away from said handle means; and second control means connected with said drive means for selectively controlling reciprocable movement of said T-bar in a direction toward said handle means.

12. The power driven spring tension hose clamp tool of claim 11, wherein said first and second links each have an equal predetermined length, said pivotal connection of said first arm to said main body being separated from said pivotal connection of said first link to said first arm a distance substantially equal to said predetermined length, said pivotal connection of said second arm to said main body being separated from said pivotal connection of said second link to said second arm a distance substantially equal to said predetermined length.

13. The power driven spring tension hose clamp tool of claim 11, wherein said drive means and said control means comprise:

primary inlet passage means in said handle means for providing connection with an external supply of compressed gas and for providing a first passageway for said compressed gas through said handle means;

secondary inlet passage means for providing a second passageway of said compressed gas through said handle means;

inlet valve means fluidically connected with said primary inlet passage means and with said secondary inlet passage means for providing selective fluidic communication of said compressed gas between said primary inlet passage means and said secondary inlet passage means;

primary outlet passage means in said handle means for providing a third passageway for said compressed gas through said handle means;

secondary outlet passage means for providing a fourth passageway of said compressed gas through said handle means to an exterior outlet aperture therein;

outlet valve means fluidically connected with said primary outlet passage means and with said secondary outlet passage means for providing selective fluidic communication of said compressed gas between said primary outlet passage means and said secondary outlet passage means;

a cylinder located in said main body, said cylinder having a head wall at one end thereof remote from said handle means, said cylinder being sealably connected with said handle means so as to be in fluidic communication with said secondary inlet passage and said primary outlet passage;

a piston reciprocably mounted in said cylinder;

a piston rod having a first end and a second end, said first end of said piston rod being connected with said piston, said piston rod passing through said head wall of said cylinder, said second end of said piston rod being connected with said T-bar at said medial location thereof; and spring means situated between said head wall of said cylinder and said piston for providing a biasing force on said piston toward said handle means.

14. The power driven spring tension hose clamp tool of claim 13, wherein said first valve means comprises a pucsh botton actuated pneumatic valve that is normally closed, said first valve means being opened by a user depressing the push button thereof; and wherein said second valve means comprises a push button actuated pneumatic valve that is normally closed, said second valve means being opened by a user depressing the push button thereof.

15. The power driven spring tension hose clamp tool of claim 14, further comprising adjustment screw means connected with at least one of said handle means and said main body for providing an abutment for said piston so as to selectively provide a maximum distance of separation of said first and second claw means.

16. The power driven spring tension hose clamp tool of claim 14, further comprising needle valve means in said handle means and fluidically communicating with at least one of said secondary inlet passage means and said primary inlet passage means for providing selective throttling of said compressed gas into said cylinder in response to said push button of said inlet valve being depressed.

17. The power driven spring tension hose clamp tool of claim 16, wherein said main body comprises a clevis portion connected with said head wall of said cylinder, said clevis portion comprising a first leg terminating in an end and a second leg terminating in an end, said T-bar being reciprocable between said first and second legs, said pivotal connection of said first arm being located at said end of said first leg, said pivotal connection of said second arm being located at said end of said second leg.

18. The power driven spring tension hose clamp tool of claim 17, wherein said first and second links each have an equal predetermined length, said pivotal connection of said first arm to said main body being separated from said pivotal connection of said first link to said first arm a distance substantially equal to said predetermined length, said pivotal connection of said second arm to said main body being separated from said pivotal connection of said second link to said second arm a distance substantially equal to said predetermined length.

* * * * *